United States Patent [19]

Sullivan

[11] 4,245,426

[45] Jan. 20, 1981

[54] WHEELED FIGURE

[76] Inventor: Mark Sullivan, Rte. 1, Box 182A, East New Market, Md. 21631

[21] Appl. No.: 44,090

[22] Filed: May 31, 1979

[51] Int. Cl.[3] ..... A63H 11/10

[52] U.S. Cl. ..... 46/103; 46/106; 46/152; 46/162; 46/116; 297/181; 5/436; 5/440; D6/203

[58] Field of Search ..... 46/103, 106, 99, 111, 46/112, 151, 152, 162, 97, 116, 157, 158, 159, 160, 123; 297/181; 280/1.13, 1.11 R, 1.189; D6/58, 201, 202, 203; 5/436, 440

[56] References Cited

U.S. PATENT DOCUMENTS

| | | | |
|---|---|---|---|
| D. 171,752 | 3/1954 | Dardenelle | D6/203 |
| 1,755,161 | 4/1930 | Weimer | 46/88 X |
| 2,181,024 | 11/1939 | Pifalo | 46/152 |
| 3,100,364 | 8/1963 | May | 46/103 |
| 3,212,212 | 10/1965 | Miller | 46/103 |
| 3,419,993 | 1/1969 | Rodgers | 46/22 |

FOREIGN PATENT DOCUMENTS

| | | | |
|---|---|---|---|
| 1129406 | 5/1962 | Fed. Rep. of Germany | 46/103 |
| 646831 | 11/1928 | France | 46/118 |

*Primary Examiner*—F. Barry Shay
*Assistant Examiner*—Mickey Yu
*Attorney, Agent, or Firm*—Birch, Stewart, Kolasch & Birch

[57] ABSTRACT

A toy that simulates a creature of nature such as a turtle is described. The toy includes a shell having two separable parts that are hinged together. A soft body portion of the creature fits within the shell. the shell has wheels to permit the toy to be pulled or ridden. The soft body portion has sufficient thickness to permit the use thereof as a pillow.

2 Claims, 4 Drawing Figures

WHEELED FIGURE

This invention relates to a toy that simulates a creature of nature, such as a turtle, that has a hard and rigid outer shell. More particularly, my invention relates to such a toy whose shell is comprised of at least two separable parts that permit the shell portion to be opened so that the soft interior body portion may be removed. The soft body portion may have an independent use as a pillow. The shell may be provided with wheels to permit the toy to be pulled or ridden by a child.

DESCRIPTION OF THE DRAWINGS

In the accompanying drawings.

Figure 1:
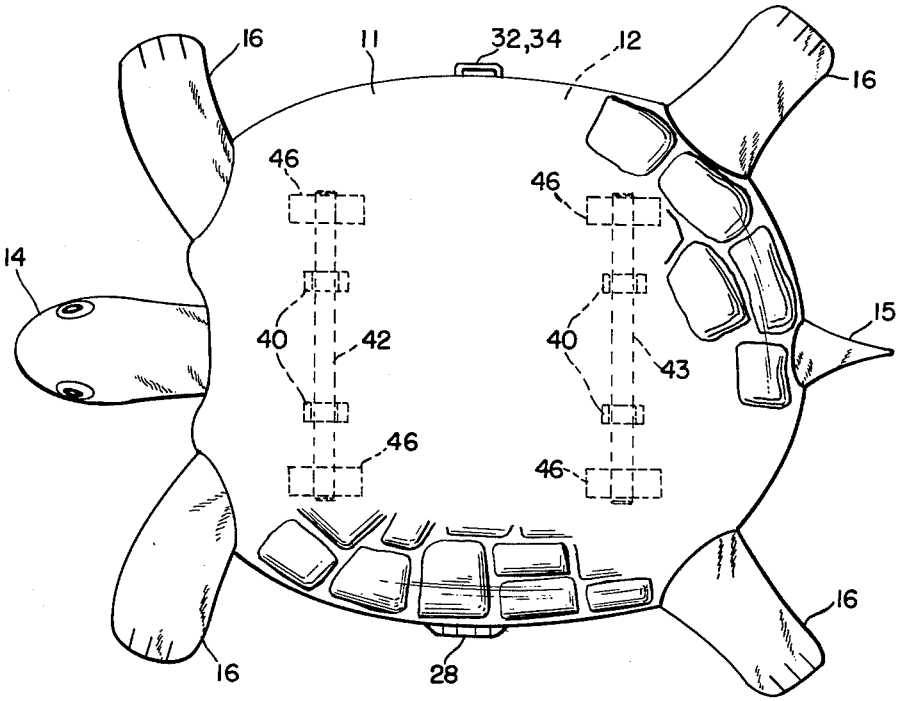
FIG. 1 is a top view of the novel toy of my invention.

Referring in detail to the drawings, the toy of my invention is shaped and colored to simulate a creature of nature, such as a turtle. The toy is comprised of two independent and removable portions 11 and 12. Portion 11 simulates the turtle's hard outer shell and is made of a substantially rigid material that will retain its shaped under anticipated conditions of use. The interior of shell portion 11 is void and is adapted to receive a soft and pliable body portion 12 that is shaped to substantially conform to the void interior of shell portion 11. Body portion 12 is separate and independent from shell 11 and appendages that extend outwardly from shell portion 11 to simulate the turtle's head 14, tail 15, and legs 16. Buttons 19 or other suitable means may be placed on the head 14 to simulate the facial features of the turtle. At least the center region 20 of the body portion 12 is soft and pliable so that it may serve as a pillow when removed from shell 11.

Figure 2:
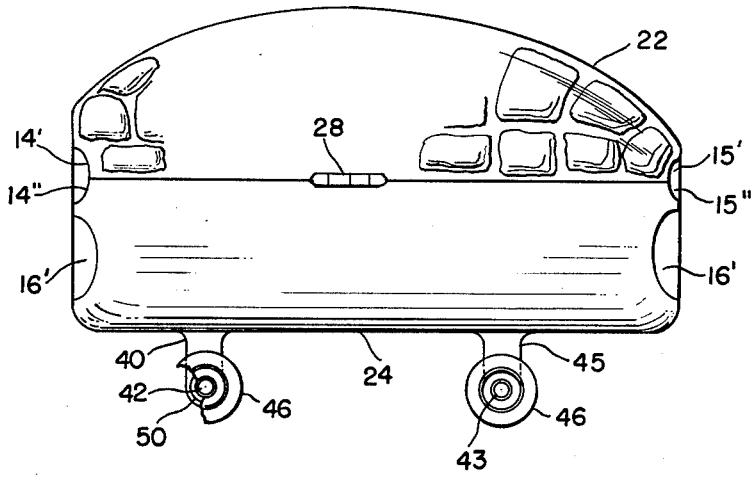
FIG. 2 is a side view of the hard shell portion of my toy.
Figure 3:
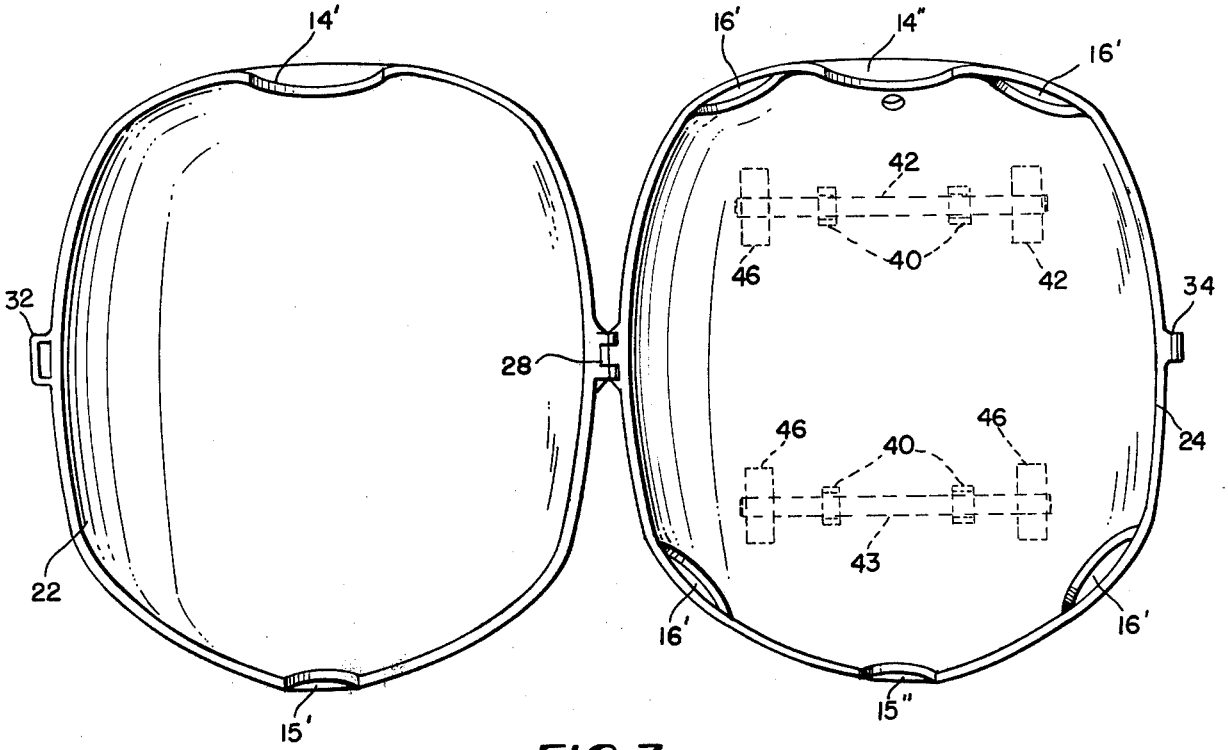
FIG. 3 is a plan view showing the upper and lower segments of the shell opened and pivoted away from each other.
Figure 4:
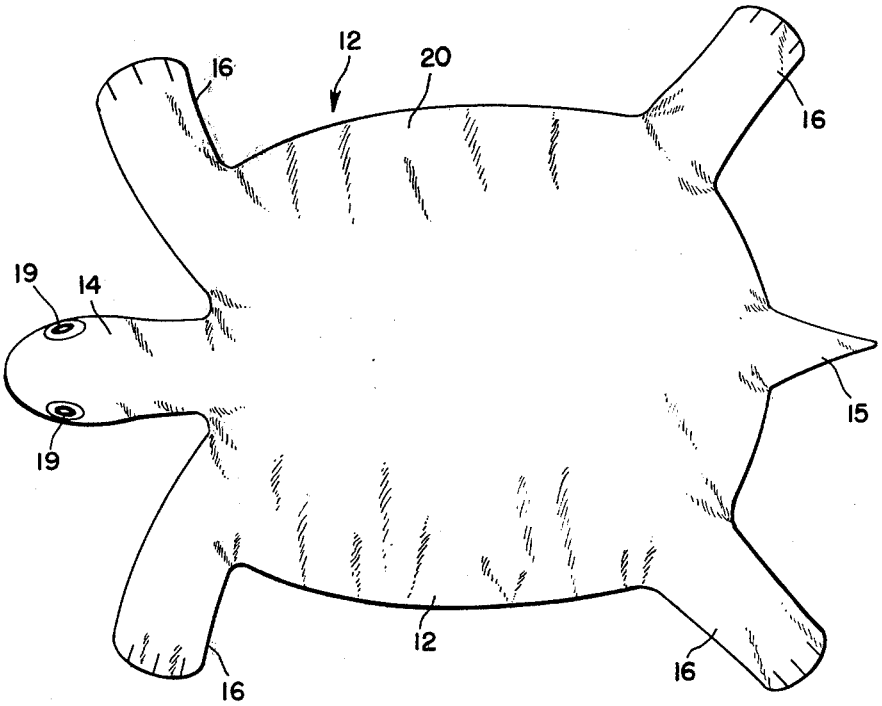
FIG. 4 is a plan view of the soft body portion of the toy of my invention.

As best seen in FIGS. 2 and 3, shell portion 11 is formed of separable upper and lower shell segments 22 and 24. The rigid shell segments desirably are molded of a suitable durable plastic material and have a wall thickness that is sufficient to provide physical support under anticipated conditions of use. The outer surfaces of the shell segments 22 and 24 may have impressions molded therein and may be suitably colored to simulate the natural markings and coloring of a turtle shell. Lower shell segment 24 has apertures 16' at its four corners to permit the legs 16 of body portion 12 to extend therethrough to the exterior of shell portion 11. Shell segments 22 and 24 have recessed regions 14', 14'' and 15', 15'' that form apertures that permit the head 14 and tail 15 of body portion 12 to extend outwardly from shell 11.

As seen in FIG. 3, a hinge 28 pivotally joins the two shell segments 22 and 24. Hinge 28 may be a separate item that is fastened to the two shell segments, or it may be a flexible plastic strap-like member that is thinner than shell segments 22 and 24 and molded integrally with them. On the side of shell segments 22 and 24 opposite hinge 28 are respective fastening means 32 and 34 that cooperate to permit shell segments 22 and 24 to be releasably held or secured together. As illustrated, means 32 and 34 are in the form of a buckle wherein the apertured member 32 snaps over the protruding member 34. Any other suitable fastening means may be utilized in place of the illustrated buckle.

If desired, hinge 28 may be replaced by another fastener similar to the illustrated buckle 32, 34 so that shell segments 22 and 24 may be completely separated from each other when the buckles are unfastened.

It is seen in FIG. 2 that lower shell segment 24 has four integrally moulded and protruding legs 40 that are provided with apertures or bushings (not illustrated) at their lower ends to receive axles 42 and 43. Wheels 46 are mounted on axles 42, 43 so that shell 11 may be pulled and/or ridden by a child. As an alternative to the protruding legs 40, suitable axle bushings 50 may be integrally moulded into lower shell segment 24. Axles then may be inserted through bushings 50 and wheels, larger than the wheels illustrated in FIG. 2, may be attached to the axles.

Desirably, body portion 12 is in the form of a "stuffed animal" that is soft, pliable, and pleasing to the touch so that it may serve as a child's pillow when it is removed from shell 11. Body portion 12 may be made of a suitably shaped outer fabric cover that is stuffed with soft and flexible natural or synthetic material. The outer cover may be removable from its inner stuffing so that it may be washed. Alternatively, body portion 12 may be made as a unitary structure from a suitable foamed plastic material.

It is to be understood that hard shell 11 may be moulded differently from the attached illustrations without departing from the teachings of my invention. Other types of creatures of nature may be simulated if desired.

What is claimed is:

1. A toy that simulates a creature of nature having a hard outer shell, comprising:

a rigid shell comprised of first and second shell segments that are separable from each other;

means for releasably holding said shell segments together to simulate the outer shell of a given creature of nature;

said shell segments being rigid and shaped to provide an interior void space when together;

an interior body portion separate and independent from said shell and adapted to fit within the void space when the shell segments are together;

appendages on said body portion simulating natural appendages on said creature of nature;

said body portion being soft and pliable and having a thickness adequate for serving as a pillow when removed from said shell;

means on said shell for permitting said appendages to extend exteriorly of the shell; and wheels mounted on the shell for permitting translation thereof.

2. A toy that simulates a creature of nature having an outer shell, comprising:

a relatively rigid outer shell that simulates the outer shell of a creature of nature;

said shell having a void interior region;

means for providing access to said void interior region;

a body portion separate from said shell and adapted to fit at least partially within said void interior region to simulate additional features of said given creature;

said body portion being made of a material to serve as a pillow when removed from said shell;

appendages on said body portion adapted to extend to the exterior of said shell;

means on said shell for permitting said appendages to pass through said shell; and wheels affixed to said shell for providing motive means for said shell.

* * * * *